US010920719B2

(12) United States Patent
Miyake

(10) Patent No.: US 10,920,719 B2
(45) Date of Patent: Feb. 16, 2021

(54) INTERNAL COMBUSTION ENGINE

(71) Applicant: TOYOTA JIDOSHA KABUSHIKI KAISHA, Aichi-ken (JP)

(72) Inventor: Satoshi Miyake, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 78 days.

(21) Appl. No.: 16/393,964

(22) Filed: Apr. 25, 2019

(65) Prior Publication Data

US 2019/0331069 A1 Oct. 31, 2019

(30) Foreign Application Priority Data

Apr. 27, 2018 (JP) ..... JP2018-087748

(51) Int. Cl.
*F02M 26/17* (2016.01)
*F02M 26/50* (2016.01)
*F02M 26/22* (2016.01)
*F02M 26/35* (2016.01)

(52) U.S. Cl.
CPC ..... *F02M 26/50* (2016.02); *F02M 26/17* (2016.02); *F02M 26/22* (2016.02); *F02M 26/35* (2016.02)

(58) Field of Classification Search
CPC ..... F02M 26/17; F02M 26/22; F02M 26/27; F02M 26/29; F02M 26/35; F02M 26/50
See application file for complete search history.

(56) References Cited

U.S. PATENT DOCUMENTS 7,934,486 B1 * 5/2011 Styles ..... F01N 3/2066 123/406.23
8,596,252 B2 * 12/2013 Liu ..... F02B 29/0412 123/568.12
2007/0006571 A1 * 1/2007 Vetrovec ..... F01N 5/02 60/281
2011/0100213 A1 * 5/2011 Finkenrath ..... F02C 1/02 95/92
2014/0316676 A1 * 10/2014 Pursifull ..... F02D 41/222 701/103
2015/0082790 A1 3/2015 Yoshioka et al.
(Continued)

FOREIGN PATENT DOCUMENTS

CN 106884746 A 6/2017
CN 107339168 A 11/2017
(Continued)

*Primary Examiner* — Thomas N Moulis
(74) *Attorney, Agent, or Firm* — Hauptman Ham, LLP

(57) ABSTRACT

A compressor that feeds intake air under pressure is attached to an intake passage of an internal combustion engine. An intercooler that cools intake air is attached to a portion of the intake passage on a downstream side of the compressor. One end of an exhaust gas recirculation passage that allows a part of exhaust air flowing in an exhaust passage to return is connected with the exhaust passage in the internal combustion engine. The other end of the exhaust gas recirculation passage is connected with a portion of the intake passage on an upstream side of the compressor. A dehumidifier that removes moisture contained in gas is attached to a portion of the intake passage from a connecting portion with the exhaust gas recirculation passage through the compressor.

5 Claims, 1 Drawing Sheet

(56) References Cited

U.S. PATENT DOCUMENTS

| | | | | |
|---|---|---|---|---|
| 2015/0101327 | A1* | 4/2015 | Clark | F02D 41/0052 60/599 |
| 2015/0107566 | A1* | 4/2015 | Sugiyama | F02M 26/15 123/568.12 |
| 2015/0240730 | A1* | 8/2015 | Styles | F02D 41/144 123/393 |
| 2016/0169165 | A1 | 6/2016 | Isogai | |
| 2017/0306894 | A1 | 10/2017 | Kikuchi | |
| 2017/0314517 | A1 | 11/2017 | Kim et al. | |
| 2017/0342949 | A1* | 11/2017 | Kikuchi | F02B 37/00 |
| 2018/0100471 | A1* | 4/2018 | Minami | F02M 26/33 |
| 2018/0119651 | A1* | 5/2018 | Minami | F02M 26/06 |
| 2018/0171864 | A1* | 6/2018 | Hakeem | F02B 33/00 |
| 2018/0202349 | A1* | 7/2018 | Kindl | F02B 29/0468 |
| 2019/0323457 | A1* | 10/2019 | Rohrssen | F02M 35/10268 |
| 2020/0025157 | A1* | 1/2020 | Romanato | F02M 26/08 |
| 2020/0300205 | A1* | 9/2020 | Pursifull | F02N 11/0822 |

FOREIGN PATENT DOCUMENTS

| | | | |
|---|---|---|---|
| EP | 2998563 | A1 | 3/2016 |
| JP | 2014-185618 | A | 10/2014 |
| JP | 2016-113936 | A | 6/2016 |
| JP | 5940727 | A | 6/2016 |
| JP | 5940727 | B2 | 6/2016 |
| JP | 2016-211471 | A | 12/2016 |
| JP | 2017-2867 | A | 1/2017 |
| JP | 2017-75608 | A | 4/2017 |
| JP | 2017-129080 | A | 7/2017 |
| JP | 2017-150494 | A | 8/2017 |
| JP | 2017-193999 | A | 10/2017 |

* cited by examiner

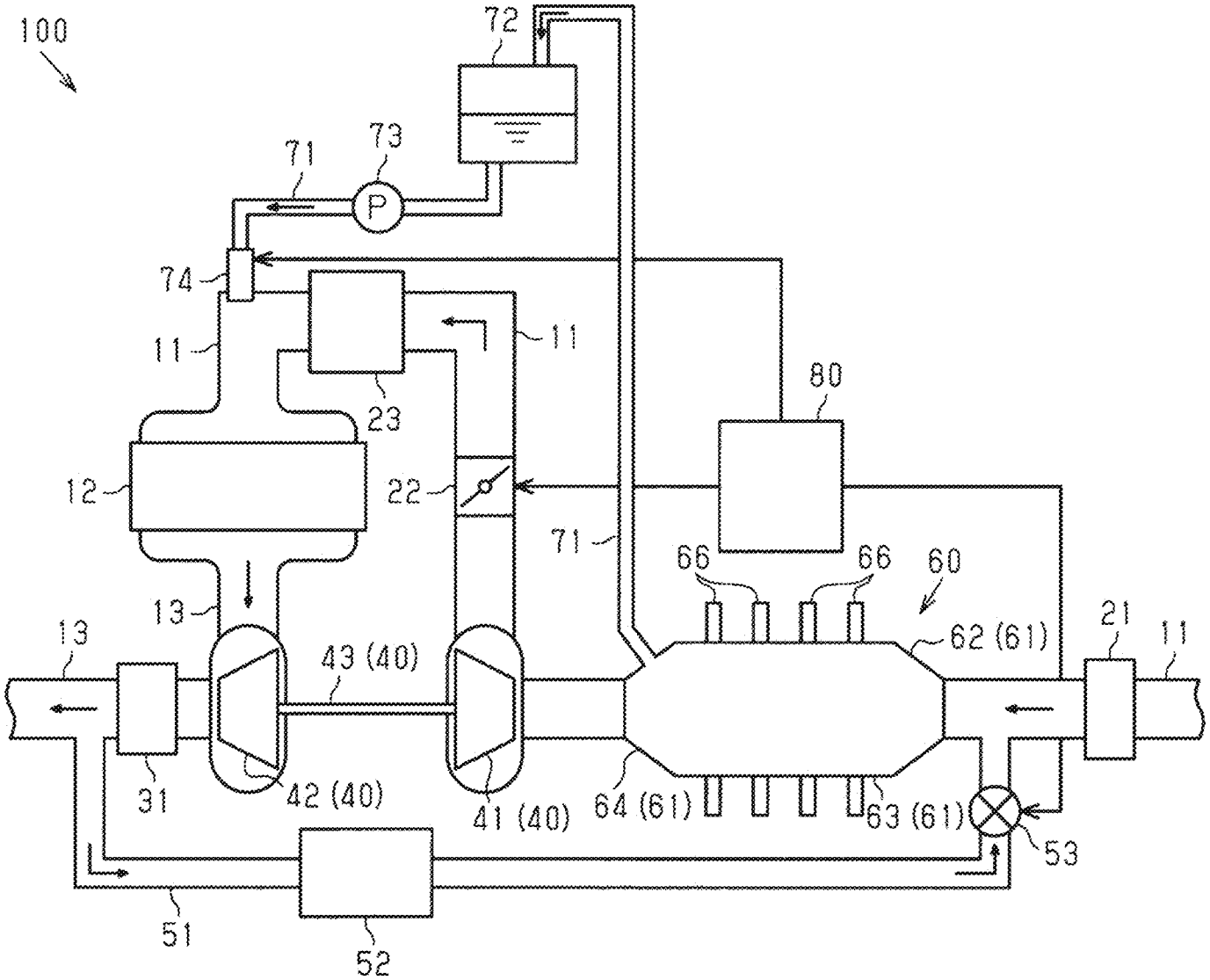
100
72
73
P
71
74
11
23
22
12
13
80
66
66
60
62 (61)
63 (61)
64 (61)
71
11
41 (40)
43 (40)
42 (40)
13
31
51
52
53
21
11

INTERNAL COMBUSTION ENGINE

INCORPORATION BY REFERENCE

The disclosure of Japanese Patent Application No. 2018-087748 filed on Apr. 27, 2018 including the specification, drawings and abstract is incorporated herein by reference in its entirety.

BACKGROUND

1. Technical Field

The disclosure relates to an internal combustion engine.

2. Description of Related Art

A compressor of a turbocharger is attached to an intake passage of an internal combustion engine disclosed in Japanese Unexamined Patent Application Publication No. 2017-002867 (JP 2017-002867 A). The compressor feeds intake air under pressure to the intake passage on a downstream side of the compressor. An intercooler that cools intake air is attached to a portion of the intake passage on the downstream side of the compressor. Meanwhile, one end of an exhaust gas recirculation (EGR) passage is connected with an exhaust passage of the internal combustion engine. The EGR passage allows a part of exhaust air flowing in the exhaust passage to return. The other end of the EGR passage is connected with a portion of the intake passage on an upstream side of the compressor.

A dehumidifier that removes moisture contained in exhaust air is attached to a middle of the EGR passage described in JP 2017-002867 A. Therefore, dehumidified exhaust air is allowed to return to a portion of the intake passage on the upstream side of the compressor.

SUMMARY

A mixture of dehumidified exhaust air and intake air taken from outside flows in the internal combustion engine described in JP 2017-002867 A on the downstream side of a portion of the intake passage where the intake passage is connected with the EGR passage. In the mixture, the intake air taken from outside is not dehumidified. Therefore, when the intercooler cools the mixture, condensed water can be generated inside the intercooler. Condensed water generated inside the intercooler can cause corrosion and so on of the intercooler.

An internal combustion engine according to the disclosure includes an intake passage in which intake air flows, an exhaust passage in which exhaust air flows, a compressor, an intercooler, an exhaust gas recirculation passage, and a dehumidifier. The compressor is provided in the intake passage and configured so as to feed intake air under pressure. The intercooler is provided in a portion of the intake passage on a downstream side of the compressor and configured to cool intake air. The exhaust gas recirculation passage is connected with the exhaust passage and returns a part of the exhaust air flowing in the exhaust passage to a portion of the intake passage on an upstream side of the compressor. The dehumidifier is provided in a portion of the intake passage from a connecting portion with the exhaust gas recirculation passage through the compressor, and configured so as to remove moisture contained in gas.

With the above configuration, it is possible to remove moisture from a mixture of intake air introduced from an outside into the intake passage and exhaust air introduced from the exhaust gas recirculation passage into the intake passage. Therefore, a dehumidified mixture flows in the intake passage on the downstream side of the dehumidifier. Thus, even when the intercooler cools the mixture, condensed water is hardly generated inside the intercooler.

In the internal combustion engine, the dehumidifier may include a heat exchanger in which the gas flows. The heat exchanger may have pipe shape. The dehumidifier may be configured to cool the gas flowing inside the heat exchanger so as to remove moisture contained in the gas. The heat exchanger may include an expanded pipe portion having a sectional area of a flow passage larger than a sectional area of a flow passage of an upstream end of the heat exchanger.

With the foregoing configuration, gas is cooled while the gas is flowing in the heat exchanger. Thus, moisture contained in the gas is condensed, and the moisture contained in the gas is thus removed. With the foregoing configuration, flow speed of the gas flowing in the expanded pipe portion of the heat exchanger becomes lower than flow speed of the gas flowing in the intake passage on the upstream side of the heat exchanger. Therefore, with the foregoing configuration, it takes longer for the gas to flow in the expanded pipe portion of the heat exchanger, and the gas is thus cooled more easily accordingly.

In the internal combustion engine described above, the heat exchanger may include a plate-shaped fin that projects from an outer peripheral surface of the heat exchanger.

With the foregoing configuration, because the fin portion is provided, heat exchange between gas inside the heat exchanger and an outside of the heat exchanger is promoted. Thus, gas inside the heat exchanger is cooled easily. In the internal combustion engine, a supply passage may be connected with the dehumidifier. The supply passage supplies condensed water to a portion of the intake passage on the downstream side of the intercooler. The condensed water is generated as moisture contained in the gas is condensed. A supply valve may be provided in the supply passage. The supply valve may be configured to switch a flow passage of the supply passage between an open state and a closed state With the above configuration, when the supply valve opens the flow passage of the supply passage, condensed water is supplied to the intake passage through the supply passage. Then, when the condensed water vaporizes inside the intake passage and inside the cylinder, and temperature of intake air drops, fuel combustion temperature inside the cylinder drops as well. Thus, it is possible to restrain generation of nitrogen oxides and so on caused by burning of fuel.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein:

FIG. 1 is an entire view of an internal combustion engine.

DETAILED DESCRIPTION OF EMBODIMENTS

An embodiment of the disclosure is described below with reference to FIG. 1. In the description below, when the terms "upstream" and "downstream" are simply used, they mean upstream and downstream in flows of intake air, exhaust air, and condensed water.

As shown in FIG. 1, an internal combustion engine 100 includes an intake passage 11 that is used to introduce intake air from an outside of the internal combustion engine 100. An air cleaner 21 that removes foreign matters contained in intake air is attached to the intake passage 11. A compressor 41 of a turbocharger 40 is attached to the intake passage 11 on a downstream side of the air cleaner 21. The compressor 41 feeds intake air under pressure to the intake passage 11 on the downstream side of the compressor 41. A throttle valve 22 is attached to the intake passage 11 on the downstream side of the compressor 41. The throttle valve 22 opens and closes a flow passage of the intake passage 11 so as to control an amount of intake air flowing in the intake passage 11. An intercooler 23 is attached to the intake passage 11 on the downstream side of the throttle valve 22. The intercooler 23 cools intake air that is fed by the compressor 41 under pressure.

A cylinder 12 is connected with a downstream end of the intake passage 11. In the cylinder 12, fuel and intake air are mixed and burnt. Fuel is injected into the cylinder 12 by a fuel injection valve (not shown), and the fuel is burnt inside the cylinder 12. An upstream end of an exhaust passage 13 for discharging exhaust air from the cylinder 12 is connected with the cylinder 12. A turbine 42 of the turbocharger 40 is attached to the exhaust passage 13. The turbine 42 is joined to the compressor 41 through a rotating shaft 43. As the turbine 42 rotates due to a flow of exhaust air, the compressor 41 also rotates. A catalyst 31 that cleans exhaust air is attached to the exhaust passage 13 on the downstream side of the turbine 42.

An upstream end of an exhaust gas recirculation (EGR) passage 51 is connected with a portion of the exhaust passage 13 on the downstream side of the catalyst 31. A downstream end of the EGR passage 51 is connected with a portion of the intake passage 11 between the air cleaner 21 and the compressor 41. The EGR passage 51 allows a part of exhaust air flowing in the exhaust passage 13 to return to a portion of the intake passage 11 on the downstream side of the air cleaner 21 and on the upstream side of the compressor 41.

An EGR cooler 52 that cools returning exhaust air is attached to the EGR passage 51. An EGR valve 53 is attached to the EGR passage 51 on the downstream side of the EGR cooler 52. The EGR valve 53 opens and closes a flow passage of the EGR passage 51 so as to control an amount of exhaust air flowing in the EGR passage 51.

A dehumidifier 60 that removes moisture contained in gas is attached to a portion of the intake passage 11 from a connecting portion with the downstream end of the EGR passage 51 through the compressor 41. A heat exchanger 61 of the dehumidifier 60 has a circular pipe shape as a whole. The heat exchanger 61 is made from a material with high thermal conductivity such as an aluminum alloy. The dehumidifier 60 exchanges heat between an inside and an outside of the heat exchanger 61 so as to cool gas that flows inside the heat exchanger 61. Then, the dehumidifier 60 condenses moisture contained in gas and removes the moisture contained in the gas.

The heat exchanger 61 is roughly divided into an upstream side pipe portion 62 positioned on the upstream side, an expanded pipe portion 63 positioned in an almost center part, and a downstream side pipe portion 64 positioned on the downstream side. An upstream end of the upstream side pipe portion 62 is connected with the intake passage 11 on the upstream side of the dehumidifier 60. An inner diameter of the upstream end of the upstream side pipe portion 62 is almost the same as an inner diameter of a downstream end of the intake passage 11 on the upstream side of the dehumidifier 60. An inner diameter of the upstream side pipe portion 62 increases towards the downstream side.

An upstream end of the expanded pipe portion 63 is connected with a downstream end of the upstream side pipe portion 62. An inner diameter of the upstream end of the expanded pipe portion 63 is almost the same as an inner diameter of the downstream end of the upstream side pipe portion 62. An inner diameter of the expanded pipe portion 63 is almost constant in an axis direction of the expanded pipe portion 63. This means that a sectional area of a flow passage in the entire expanded pipe portion 63 is larger than a sectional area of a flow passage at the upstream end of the upstream side pipe portion 62 of the heat exchanger 61.

An upstream end of the downstream side pipe portion 64 is connected with a downstream end of the expanded pipe portion 63. An inner diameter of the upstream end of the downstream side pipe portion 64 is almost the same as an inner diameter of the downstream end of the expanded pipe portion 63. An inner diameter of the downstream side pipe portion 64 becomes smaller towards the downstream side. A downstream end of the downstream side pipe portion 64 is connected with the intake passage 11 on the downstream side of the dehumidifier 60. An inner diameter of the downstream end of the downstream side pipe portion 64 is almost the same as an inner diameter of an upstream end of the intake passage 11 on the downstream side of the dehumidifier 60.

A plurality of fin portions 66 projects from an outer peripheral surface of the expanded pipe portion 63 of the heat exchanger 61 to a radially outer side of the expanded pipe portion 63. The fin portions 66 have an almost plate shape extending in a circumferential direction of the expanded pipe portion 63. When seen in the axis direction of the expanded pipe portion 63, the fin portions 66 have a ring shape as a whole. In the embodiment, a material of the fin portions 66 is an aluminum alloy that is the same as the material of the heat exchanger 61. This means that the fin portions 66 and the heat exchanger 61 have almost the same thermal conductivity. Also, in the embodiment, the fin portions 66 are fixed to the outer peripheral surface of the expanded pipe portion 63 of the heat exchanger 61 by welding. In FIG. 1, the number and shape of the fin portions 66 are simplified.

An upstream end of a supply passage 71 is connected with the heat exchanger 61. The upstream end of the supply passage 71 is connected with a lowermost position of the heat exchanger 61 in a vertical direction in a state where the heat exchanger 61 is mounted on a vehicle. A downstream end of the supply passage 71 is connected with a portion of the intake passage 11 on the downstream side of the intercooler 23. The supply passage 71 supplies condensed water generated in the heat exchanger 61 to a portion of the intake passage 11 on the downstream side of the intercooler 23.

A condensed water tank 72 that stores condensed water generated in the heat exchanger 61 is attached to the supply passage 71. In a state where the condensed water tank 72 is mounted on a vehicle, the condensed water tank 72 is disposed at a position lower than the heat exchanger 61 in the vertical direction. Therefore, condensed water generated in the heat exchanger 61 is guided by gravity to the condensed water tank 72 through the supply passage 71. A pump 73 is attached to the supply passage 71 on the downstream side of the condensed water tank 72. The pump 73 feeds condensed water under pressure from a side of the condensed water tank 72 to a side of the intake passage 11 on the downstream side of the intercooler 23. A supply valve 74 that switches a flow passage of the supply passage 71 between an open state and a closed state is attached a downstream end portion of the supply passage 71. The supply valve 74 injects condensed water into the intake passage 11, the condensed water being fed by the pump 73 under pressure.

A control device 80 opens and closes the throttle valve 22, the EGR valve 53, and the supply valve 74. The control device 80 outputs a control signal to the throttle valve 22 so as to control the throttle valve 22 to open and close. Also, the control device 80 outputs a control signal to the EGR valve 53 so as to control the EGR valve 53 to open and close. The control device 80 outputs a control signal to the supply valve 74 so as to control the supply valve 74 to open and close. In the embodiment, the control device 80 is configured as an electronic control unit (ECU) that controls the entire internal combustion engine 100 such as control of an amount of fuel injected by the fuel injection valve, and control of a supercharging operation by the turbocharger 40.

Hereinafter, actions and effects of the embodiment are described. As shown in FIG. 1, in the internal combustion engine 100, intake air is introduced into the cylinder 12 from the intake passage 11. Inside the cylinder 12, fuel is mixed with intake air and burnt, and high-temperature exhaust air is discharged from the cylinder 12 to the exhaust passage 13. At this point, when the EGR valve 53 is controlled to open, a part of exhaust air flowing in the exhaust passage 13 is returned through the EGR passage 51 to the portion of the intake passage 11 on the downstream side of the air cleaner 21 and on the upstream side of the compressor 41.

In the embodiment, the dehumidifier 60 is attached to the portion of the intake passage 11 from the connected portion with the downstream end of the EGR passage 51 through the compressor 41. Therefore, a mixture of intake air introduced into the intake passage 11 from an outside and exhaust air introduced into the intake passage 11 from the EGR passage 51 flows inside the heat exchanger 61 of the dehumidifier 60 and is thus cooled. Then, inside the heat exchanger 61 of the dehumidifier 60, moisture contained in the mixture is condensed, and most of the moisture contained in the mixture is removed. Thus, dehumidified mixture flows in the intake passage 11 on the downstream side of the dehumidifier 60. As a result, even when the intercooler 23 cools the mixture, condensed water is hardly generated inside the intercooler 23. It is thus possible to restrain corrosion and so on of the intercooler 23 caused by condensed water generated inside the intercooler 23.

Further, even when the dehumidifier 60 is attached to a portion of the intake passage 11 on the upstream side of the intercooler 23, condensed water can be generated inside the compressor 41 if the dehumidifier 60 is attached to a portion of the intake passage 11 on the downstream side of the compressor 41. On the contrary, in the embodiment, since the dehumidifier 60 is attached to the portion of the intake passage 11 on the upstream side of the compressor 41, condensed water is hardly generated inside the compressor 41.

In the embodiment, a sectional area of a flow passage of the expanded pipe portion 63 of the heat exchanger 61 is larger than a sectional area of a flow passage of the upstream end of the upstream side pipe portion 62 of the heat exchanger 61. Therefore, flow speed of a mixture flowing in the expanded pipe portion 63 in the heat exchanger 61 is lower than flow speed of a mixture flowing in the intake passage 11 on the upstream side of the heat exchanger 61. Therefore, in the embodiment, it takes longer for the mixture to flow in the expanded pipe portion 63 of the heat exchanger 61, thereby allowing the mixture to be cooled more easily.

Further, in the embodiment, the fin portions 66 project from the outer peripheral surface of the expanded pipe portion 63 of the heat exchanger 61 to the radially outer side of the expanded pipe portion 63. Therefore, in the embodiment, because the fin portions 66 are provided, heat of the heat exchanger 61 is dissipated to an outside easily. Therefore, heat exchange between a mixture inside the heat exchanger 61 and an outside of the heat exchanger 61 is promoted. As a result, a mixture flowing inside the heat exchanger 61 is cooled easily.

Moreover, in the embodiment, a material of the fin portions 66 and a material of the heat exchanger 61 are both an aluminum alloy having relatively high thermal conductivity. Therefore, heat of a mixture flowing inside the heat exchanger 61 is easily dissipated to an outside of the heat exchanger 61 by the fin portions 66 and the heat exchanger 61.

In the embodiment, condensed water generated inside the heat exchanger 61 of the dehumidifier 60 is guided to the condensed water tank 72 through the supply passage 71. Then, condensed water inside the condensed water tank 72 is fed under pressure by the pump 73 from a side of the condensed water tank 72 to a side of the intake passage 11 on the downstream side of the intercooler 23. Here, when the supply valve 74 is controlled to be in the open state, the condensed water that is fed under pressure is supplied into the intake passage 11. Once the condensed water vaporizes inside the intake passage 11 and inside the cylinder 12 and temperature of intake air drops, combustion temperature of fuel that is burnt inside the cylinder 12 drops as well. Thus, generation of nitrogen oxides due to burning of the fuel is restrained.

The embodiment can be carried out with the changes made as follows. The embodiment and modifications below may be combined with each other and carried out unless there is any technical inconsistency. In the foregoing embodiment, the configuration of the heat exchanger 61 of the dehumidifier 60 can be changed as appropriate. For example, the heat exchanger 61 of the dehumidifier 60 may be bent. When the heat exchanger 61 is bent, a length of a flow passage of the heat exchanger 61 is easily ensured even in a relatively small space. Further, when the heat exchanger 61 is bent, flow speed of a mixture flowing in the heat exchanger 61 is reduced easily.

In the heat exchanger 61, it is not necessary to provide the expanded pipe portion 63 that has a larger sectional area of the flow passage than that of the upstream end of the upstream side pipe portion 62. For example, in the modification described above, when the flow passage of the heat exchanger 61 is long enough, dehumidification is sufficiently carried out without providing the expanded pipe portion 63.

In the foregoing embodiment, the heat exchanger 61 of the dehumidifier 60 may have any shape as long as gas is able to flow inside the heat exchanger 61. The heat exchanger 61 may have an elliptical tube shape or a quadrangle tube shape as a whole, and a partition may divide an inside of the heat exchanger 61.

In the foregoing embodiment, a material of the heat exchanger 61 of the dehumidifier 60 may be changed. For example, the material of the heat exchanger 61 may be changed to a metal with high thermal conductivity other than an aluminum alloy. Corrosion of the heat exchanger 61 may be restrained by coating an inner peripheral surface of the heat exchanger 61. Similarly, a material of the fin portions 66 may be changed to a metal other than an aluminum alloy. In this case, it is preferred that the material of the fin portions 66 is changed to a material with almost the same thermal conductivity as that of the heat exchanger 61 or a material with higher thermal conductivity than that of the heat exchanger 61.

In the foregoing embodiment, a configuration for fixing the fin portions 66 to the heat exchanger 61 may be changed as appropriate. For example, the heat exchanger 61 and the fin portions 66 may be formed integrally with each other by casting. In the foregoing embodiment, a configuration of the fin portions 66 of the dehumidifier 60 can be changed as appropriate. For example, the fin portions 66 may project from the upstream side pipe portion 62, the expanded pipe portion 63, and the downstream side pipe portion 64 of the heat exchanger 61. Also, the fin portions 66 may be provided in a part of the heat exchanger 61 in the circumferential direction.

In the foregoing embodiment, the fin portions 66 of the dehumidifier 60 may be omitted. For example, a pipe where cooling water flows may be fixed to the outer peripheral surface of the heat exchanger 61, and cooling water may flow inside the pipe. Thus, heat of the heat exchanger 61 is dissipated outside. Thus, the fin portions 66 may be omitted as long as gas is cooled sufficiently inside the heat exchanger 61.

In the foregoing embodiment, it is possible to use other dehumidifier than the dehumidifier that cools gas so as to remove moisture contained in the gas. For example, a so-called cyclone dehumidifier may be employed that uses a swirling flow to remove moisture contained in gas. Specifically, a body portion of the cyclone dehumidifier has an almost circular pipe shape, and gas is allowed to flow along an inner peripheral surface of the body portion so that the gas swirls inside the body portion. Then, moisture contained in the gas is removed by centrifugal force generated by the swirl of the gas.

In the foregoing configuration, instead of the turbocharger 40, a supercharger driven by rotation of a crankshaft of the internal combustion engine 100 may be applied. Thus, a compressor of the supercharger may be applied to the intake passage 11 instead of the compressor 41 of the turbocharger 40. Similarly, instead of the turbocharger 40, an electric supercharger driven by an electric motor may be applied.

What is claimed is:

1. An internal combustion engine comprising:

an intake passage in which intake air flows;

an exhaust passage in which exhaust air flows;

a compressor that is provided in the intake passage and configured so as to feed intake air under pressure;

an intercooler that is provided in a portion of the intake passage on a downstream side of the compressor and configured to cool intake air;

an exhaust gas recirculation passage that is connected with the exhaust passage and allows a part of the exhaust air flowing in the exhaust passage to return to a portion of the intake passage on an upstream side of the compressor; and a dehumidifier that is provided in a portion of the intake passage from a connecting portion with the exhaust gas recirculation passage through the compressor, and configured so as to remove moisture contained in gas.

2. The internal combustion engine according to claim 1, wherein:

the dehumidifier includes a heat exchanger in which the gas flows, the heat exchanger has pipe shape;

the dehumidifier is configured to cool the gas flowing inside the heat exchanger so as to remove moisture contained in the gas; and the heat exchanger includes an expanded pipe portion having a sectional area of a flow passage larger than a sectional area of a flow passage of an upstream end of the heat exchanger.

3. The internal combustion engine according to claim 1 wherein:

the dehumidifier includes a heat exchanger in which the gas flows, the heat exchanger has pipe shape;

the dehumidifier is configured to cool the gas flowing inside the heat exchanger so as to remove moisture contained in the gas; and the heat exchanger includes a plate-shaped fin that projects from an outer peripheral surface of the heat exchanger.

4. The internal combustion engine according to claim 2 wherein the heat exchanger includes a plate-shaped fin portion that projects from an outer peripheral surface of the heat exchanger.

5. The internal combustion engine according to claim 1, wherein:

a supply passage is connected with the dehumidifier, the supply passage supplying condensed water to a portion of the intake passage on a downstream side of an intercooler, the condensed water generated as moisture contained in the gas is condensed; and a supply valve is provided in the supply passage, the supply valve being configured to switch a flow passage of the supply passage between an open state and a closed state.

* * * * *